US007708022B2

(12) United States Patent
Joen-an Ma

(10) Patent No.: US 7,708,022 B2
(45) Date of Patent: May 4, 2010

(54) UMBRELLA ASSEMBLY WITH TILT ADJUSTMENT

(76) Inventor: Oliver Joen-an Ma, 29 W. Wisteria, Arcadia, CA (US) 91007

( * ) Notice: Subject to any disclaimer, the term of this patent is extended or adjusted under 35 U.S.C. 154(b) by 564 days.

(21) Appl. No.: 11/324,952

(22) Filed: Jan. 4, 2006

(65) Prior Publication Data

US 2006/0278262 A1 Dec. 14, 2006

Related U.S. Application Data

(60) Provisional application No. 60/710,774, filed on Aug. 24, 2005.

(30) Foreign Application Priority Data

Jun. 8, 2005 (CN) ..... 2005 2 0102776 U

(51) Int. Cl.
*A45B 17/00* (2006.01)

(52) U.S. Cl. ..... 135/20.1; 135/20.3; 135/21

(58) Field of Classification Search ..... 135/20.1, 135/20.3, 21

See application file for complete search history.

(56) References Cited

U.S. PATENT DOCUMENTS

| | | | |
|---|---|---|---|
| 2,235,518 | A | 3/1941 | Goshaw |
| 2,475,406 | A | 7/1949 | Russell |
| 2,661,752 | A | 12/1953 | Kampf et al. |
| 2,905,187 | A | 9/1959 | Croce |
| 3,120,238 | A | 2/1964 | Glatz |
| 3,145,720 | A | 8/1964 | Torii |
| 4,586,525 | A | 5/1986 | Glatz et al. |
| 4,622,987 | A | 11/1986 | Redl et al. |
| 4,674,523 | A | 6/1987 | Glatz |
| 4,697,606 | A | 10/1987 | Ma |
| 4,878,509 | A | 11/1989 | Tung |
| 5,002,081 | A | 3/1991 | Stromeyer |
| 5,029,596 | A | 7/1991 | Tung |
| 5,156,395 | A | 10/1992 | Smith |
| 5,161,764 | A | 11/1992 | Roney |

(Continued)

FOREIGN PATENT DOCUMENTS

| | | | |
|---|---|---|---|
| CN | 2419864 | Y | 2/2001 |

(Continued)

OTHER PUBLICATIONS

Operation Manual Easy Sun Parasol Sunshade (Issue: Jul. 2004) pp. 1-17.

(Continued)

*Primary Examiner*—David Dunn
*Assistant Examiner*—Danielle Jackson
(74) *Attorney, Agent, or Firm*—Knobbe, Martens, Olson & Bear LLP

(57) ABSTRACT

An umbrella is provided that comprises a support pole, a suspending pole mounted transversely to the support pole, a hub, a canopy, and means for coupling and decoupling the hub from the suspending pole. The suspending pole has first and second ends and a longitudinal axis that defines an arc. The hub is attached to second end of suspending pole. The canopy is suspended in use from the hub. The coupling and decoupling means permits the canopy to be rotated about the longitudinal axis of the supporting pole.

31 Claims, 8 Drawing Sheets

U.S. PATENT DOCUMENTS

| | | | | |
|---|---|---|---|---|
| 5,349,975 | A | 9/1994 | Valdner | |
| 5,499,644 | A | 3/1996 | Geniele | |
| 5,584,564 | A | 12/1996 | Phyle | |
| 5,611,364 | A | 3/1997 | Woods | |
| 5,678,585 | A | 10/1997 | May | |
| 5,735,302 | A | 4/1998 | Saliva | |
| 5,785,069 | A | 7/1998 | Glatz | |
| D398,443 | S | 9/1998 | Bolle | |
| 5,845,665 | A | 12/1998 | Koehn | |
| 5,937,882 | A | 8/1999 | Harbaugh | |
| 6,014,980 | A | 1/2000 | Glatz | |
| D434,215 | S | 11/2000 | Lin | |
| 6,152,156 | A | 11/2000 | Tung | |
| D434,556 | S | 12/2000 | Lin | |
| 6,220,261 | B1 | 4/2001 | Glatz | |
| 6,311,705 | B1 | 11/2001 | Ma | |
| 6,435,444 | B1 * | 8/2002 | Lin | 242/396.6 |
| 6,478,037 | B2 | 11/2002 | Tung | |
| 6,520,192 | B1 | 2/2003 | Lo | |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| 6,619,306 | B2 | 9/2003 | Ma | |
| 6,662,815 | B2 | 12/2003 | Tung | |
| D497,479 | S | 10/2004 | Yu | |
| 6,837,255 | B2 | 1/2005 | Bunch et al. | |
| 6,840,253 | B2 | 1/2005 | Ma | |
| 6,851,823 | B2 | 2/2005 | Bilotti | |
| 6,923,193 | B2 | 8/2005 | Chen | |
| 6,926,019 | B2 | 8/2005 | Glatz | |
| 6,953,043 | B2 | 10/2005 | Yu | |
| 6,988,504 | B1 * | 1/2006 | Goldwitz | 135/20.1 |
| D518,629 | S | 4/2006 | Ma | |
| 7,134,442 | B2 | 11/2006 | Ma | |
| 7,493,909 | B2 | 2/2009 | Ma | |
| 7,533,680 | B2 | 5/2009 | Ma | |
| 2002/0083969 | A1 | 7/2002 | Tung | |
| 2002/0104557 | A1 | 8/2002 | Tung | |
| 2003/0010366 | A1 | 1/2003 | Glatz | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0182429 | A1 | 9/2004 | Chen | |
| 2005/0183762 | A1 | 8/2005 | Ma | |
| 2005/0229957 | A1 | 10/2005 | Glatz | |
| 2005/0268952 | A1 | 12/2005 | Ma | |
| 2006/0201542 | A1 | 9/2006 | Ma | |

FOREIGN PATENT DOCUMENTS

| | | | |
|---|---|---|---|
| DE | 580503 | | 7/1933 |
| DE | 3229776 | A1 | 4/1983 |
| DE | 3820573 | A1 | 8/1989 |
| DE | 202 05 561 | U1 | 7/2002 |
| EP | 0 392 989 | | 10/1990 |
| EP | 1 400 186 | | 3/2004 |
| GB | 22218 | | 9/1911 |
| WO | WO 97/04682 | | 2/1997 |
| WO | WO 00/55456 | | 9/2000 |
| WO | WO 2005/018369 | A1 | 3/2005 |

OTHER PUBLICATIONS

Page 2 of Treasure Garden, Inc.'s product brochure identified as "AG3 9' Centilever Umbrella".
Notice of Allowability regarding U.S. Appl. No. 11/134,074.
U.S. Appl. No. 11/066,132, filed Feb. 24, 2005, Ma.
U.S. Appl. No. 11/134,074, filed May 20, 2005, Ma.
U.S. Appl. No. 11/211,127, filed Aug. 24, 2005, Ma.
European Patent Application No. 05255414.4 Search Report dated Jun. 6, 2006.

* cited by examiner

UMBRELLA ASSEMBLY WITH TILT ADJUSTMENT

CROSS-REFERENCE TO RELATED APPLICATIONS

This application claims the benefit under 35 U.S.C. §119 (e) of U.S. Provisional Application No. 60/710,774, filed Aug. 24, 2005, and claims priority under 35 U.S.C. §119(a) to Utility Model No. 200520102776.0, filed Jun. 8, 2005 in the Peoples Republic of China.

BACKGROUND OF THE INVENTION

1. Field of the Invention

The invention relates to the field of shade structures, particularly umbrella and parasol devices and more particularly to an umbrella or parasol with an adjustable tilt feature.

2. Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly that is frequently generally circular and which comprises fabric-like material mounted over a plurality of support ribs. The support ribs can be collapsed into a storage position for the canopy and can be deployed and supported in position to hold up and extend the fabric canopy and thereby provides shade and protection from the elements. The canopy assembly is generally supported above users of the umbrella or parasol, generally either by support structures that extend from the ground to underneath the canopy assembly, or by support structures that extend to above the canopy assembly and support it from above. Such suspended umbrellas have the advantage of providing space below the canopy where people can sit without the obstruction of a pole extending from below the canopy to the ground.

One consideration in the use and design of umbrellas or parasols is that the incident sunlight and environmental elements which the users may wish to be shielded against, for example rain which may be wind-driven, is subject to change. As another example, the incident angle of sunlight changes throughout the course of a day as the sun traverses across its daily path. Similarly, wind can come from any direction and can cause rain to fall from a variety of directions other than generally vertically. Thus, in many applications, it is a desirable feature that an umbrella or parasol assembly be provided with some sort of adjustment or variable positioning to accommodate such shifts in the direction of sun, wind and weather generally.

For example, Patent Application Publication No. US 2004/0069333 A1 listing Ma as inventor discloses an umbrella in which a shade canopy is suspended from a side arm that is mounted to a side post. The side arm, and thereby the canopy, can be rotated between specific positions by means of a drive bar that can be manipulated to both rotate the side arm and latch it in one of the positions. Thus, while this design provides some ability to tilt the canopy by rotation of its suspending side arm, that rotation can only be achieved between fixed latch positions and is therefore of limited convenience.

U.S. Pat. Nos. 6,152,156 and 6,478,037 to Tung disclose another variation of a sunshade with tiltable canopy, wherein a canopy assembly is suspended from above by an arcuate tube that is hingedly connected to a generally vertically extending support pole. Thus, by adjustment of the hinged interconnection between the arcuate tube and the vertical support pole, the canopy assembly of the Tung '156 and '037 devices can be tilted inwards and outwards from a generally vertically extending orientation. However, this construction appears to only offer a tilt in a single direction away from the generally vertical support pole.

SUMMARY OF THE INVENTION

This invention provides an umbrella in which a canopy can be suspended from a hub or head assembly coupled to a pole and in which the canopy can be rotated about the axis of the pole by selectively decoupling the hub or head from the pole.

One embodiment of this invention provides an umbrella that comprises a support pole, at least a portion of which extends upwardly in use, a suspending pole, a canopy, and a mechanism for enabling tilting of the canopy. The suspending pole is mounted transversely to the support pole and has first and second ends and a longitudinal axis. The canopy is suspended in use from the second end of the suspending pole. The tilt enabling mechanism or tilting mechanism enables tilting of the canopy about the longitudinal axis of the supporting pole. The tilting mechanism comprises an actuator, such as a lever or crank, adjacent the first end of the suspending pole and a locking mechanism. The locking mechanism comprises a locking device operably coupled with the actuator and located adjacent the second end of the suspending pole. Operation of the actuator releases the locking device permitting the canopy to tilt about the longitudinal axis.

Another embodiment of this invention provides an umbrella that comprises a support pole, a suspending pole, mounted transversely to the support pole, a hub, a canopy, and means for coupling and decoupling the hub from the suspending pole. At least a portion of the support pole extends upwardly in use. The suspending pole has first and second ends and a longitudinal axis that defines an arc. The hub is attached to second end of suspending pole. The canopy is suspended in use from the hub. The coupling and decoupling means permits the canopy to be rotated about the longitudinal axis of the supporting pole.

Preferably the umbrella comprises a head or hub assembly between the second end of the suspending pole and the canopy and from which the canopy is suspended, in use, the head assembly being coupled to the second end of the suspending pole by means of the locking mechanism to normally prevent rotation of the head assembly with respect to the suspending pole, such rotation being permitted upon release of the locking device to decouple the head assembly from the second end of the suspending pole.

The longitudinal axis of the suspending pole in the umbrella of the invention is preferably curved i.e. defines an arc.

Preferably the umbrella comprises a tension member extending between the actuator and the locking device, the tension member applying a force to the locking device to release the locking device upon operation of the actuator. The tension member can be a wire or the like. The tension member is preferably coupled to the shaft having a mount post, the shaft being coupled with the actuator such that actuation thereof rotates the mount post, whereby a force is applied to the tension member.

Preferably the locking mechanism further comprises a first gear coupled with the head assembly and a second gear coupled with the suspending pole adjacent the second end thereof, wherein actuation of the actuator permits relative movement between the first and second gears such that the locking device is disengaged. In a preferred embodiment actuation of the actuator moves the second gear way from the first gear to disengage the locking device. The gears can be biased into engagement by a spring member or the like when the actuator is in its rest or inactive position.

In a preferred embodiment, actuation of the actuator moves the second gear along the longitudinal axis of the suspending pole. This movement can preferably be along an axle connected to the suspending pole adjacent the second end thereof about which the canopy can be tilted when the locking device is disengaged.

The mechanism preferably extend at least partially through the axle, and can comprise a rope, wire or the like coupled at one end with the canopy and at an opposite end with a crank mechanism.

One embodiment of the invention provides an umbrella comprising a support pole, at least a portion of which extends upwardly in use; a suspending pole, mounted transversely to the support pole and having first and second ends and a longitudinal axis that defines an arc; a hub or head attached to second end of suspending pole; a canopy suspended in use from the hub; and means for coupling and decoupling the hub from the suspending pole to permit rotating the canopy about the longitudinal axis of the supporting pole. Preferably, the coupling and decoupling means is at least in part located adjacent the second end of the suspending pole. In a preferred embodiment, the coupling and decoupling means comprises a pair of gears located adjacent the second end of the suspending pole, one of said gears being coupled with the suspending pole and the other of said gears being coupled with the hub, the coupling and decoupling means being actuatable by a lever or crank located adjacent the first end of the suspending pole.

Preferably, the coupling and decoupling means comprises a first connector in the suspending pole and having a first mating surface and a second connector in the hub and having a second mating surface, the first connector having a portion being movable with respect to the second connector so that the first mating surface can be engaged or disengaged with the second mating surface to lock or release, respectively, the hub with respect to the suspending pole, so that the hub can be rotated with respect to the suspending pole. To provide locking or engagement of the coupling means during normal use means for biasing the first connector into locking engagement with the second connector can be provided.

Preferably, first second connectors has an internal passageway, said umbrella further comprising a pin extending from the first connector into the passageway in the second connector and about which the second connector and the hub can rotate.

In another embodiment the umbrella further comprising means adjacent the first end of the suspending pole for operating the means for coupling and decoupling the hub from the suspending pole.

Preferably the operating means comprises, a crank shaft; an elongate member connected to the crank shaft and the first connector; and a crank handle for applying tension to the elongate member to effectuate disengagement of said mating surfaces.

BRIEF DESCRIPTION OF THE DRAWINGS

Some preferred embodiments of the invention will now be more particularly described by reference to the accompanying drawings in which.

DETAILED DESCRIPTION OF PREFERRED EMBODIMENTS

Figure 1:
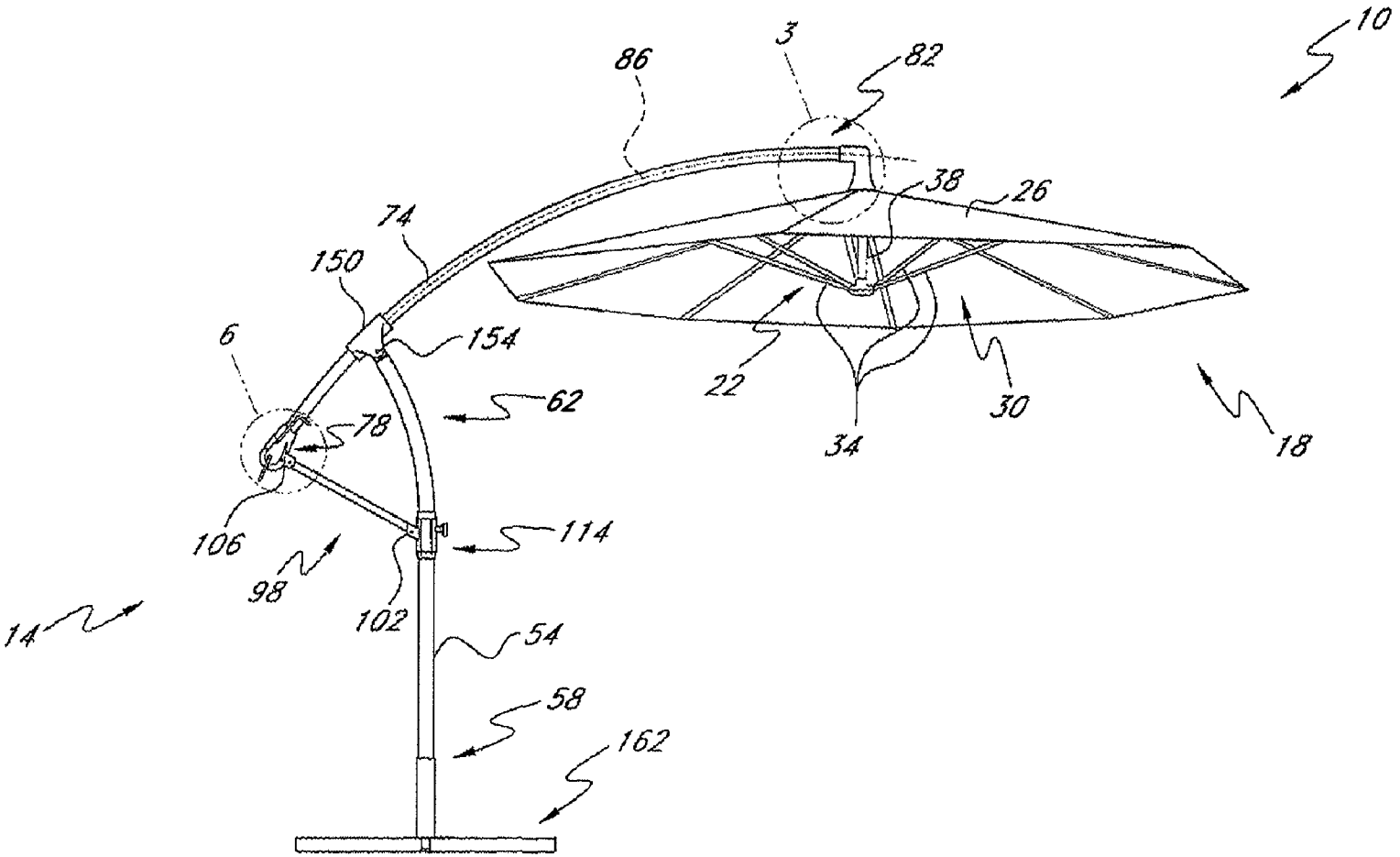
FIG. 1 is a plan view of an umbrella according to one embodiment of the invention with a canopy thereof shown in an open configuration and in a first, substantially horizontal orientation.

FIG. 1 illustrates one embodiment of the invention, in which an umbrella 10 that can be positioned in a variety of useful positions or orientation to provide shelter. To achieve this, as discussed further below, the umbrella 10 includes a plurality of mechanisms to move a sheltering member, e.g., a canopy, a canopy assembly, or a canopy fabric, between a plurality of useful positions or orientation. In some embodiments discussed below, a locking mechanism is disengaged to permit the canopy to move between a plurality of positions.

The umbrella 10 includes a support pole assembly 14 and a canopy assembly 18. As discussed further below, the umbrella 10 is configured to position the canopy assembly 18, for example, by disengaging a locking mechanism. The canopy assembly 18 includes a canopy frame 22 and a canopy fabric 26. The canopy frame 22 can take any suitable form and preferably is able to be opened and closed, such that the canopy fabric 26 can be expanded to provide shelter or closed to take up a minimum space.

In one embodiment of the invention, the canopy assembly 18 comprises a rib assembly 30 that includes a plurality of ribs 34. The ribs 34 extend from a central shaft 38. The canopy fabric 26 can be a natural or synthetic material and can be extended over the ribs 34. As discussed further below, in some embodiments, the umbrella 10 includes a mechanism for opening and closing the canopy assembly 18.

Figure 3:
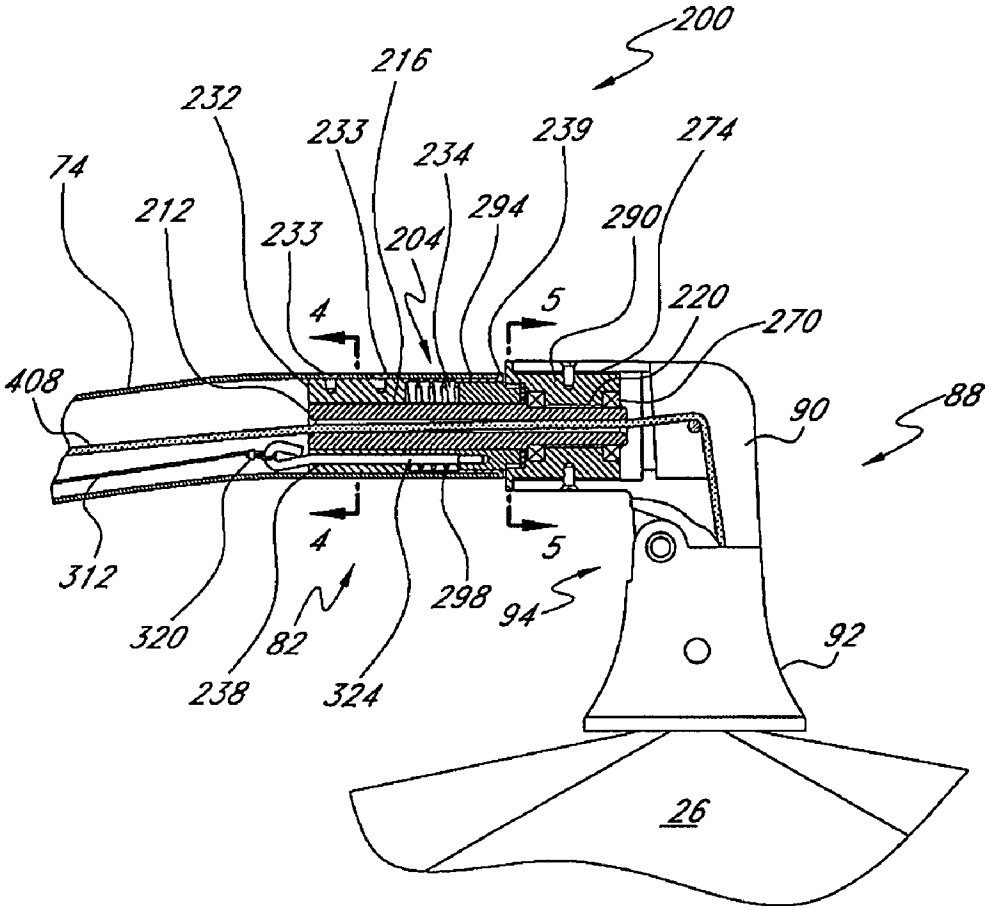
FIG. 3 is a partial cross-section view illustrating detail 3-3 of the umbrella of FIG. 1, showing a portion of a locking mechanism in a locked, a coupled, or an engaged configuration.
Figure 4:
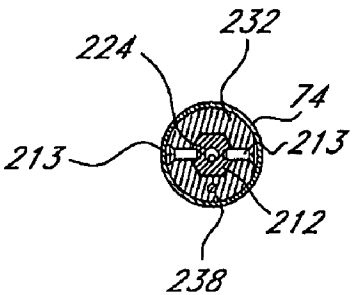
FIG. 4 is a cross-section view of an upper portion of the umbrella of FIG. 1 taken along section plane 4-4.

The support pole assembly 14 is configured to position the canopy assembly 18 as needed. In one embodiment, the support pole assembly 14 includes a support pole 54 that extends between a lower end 58 and an upper end 62. The support pole assembly 14 preferably also includes a suspending pole 74 that extends between the first end 78 and the second end 82. The first end 78 is a lower end of the suspending pole 74 and the second end 82 is an upper end of the suspending pole 74. The canopy assembly 18 can be coupled with the second end 82 of suspending pole 74 in any suitable manner. Preferably, as discussed further below, the suspending pole 74 is coupled with the support pole 54 in a manner that permits the canopy fabric 26 to be tilted about a longitudinal axis 86 of the suspending pole 74. The suspending pole 74 can take any suitable form. For example, the suspending pole 74 can be shaped to meet particular design needs. In some embodiments, it is desirable for the suspending pole 74 to be at least partially curved. Preferably, the longitudinal axis 86 of the suspending pole 74 defines an arc along a majority of its length, more preferably along substantially its entire length. In some arrangements, a portion of the longitudinal axis 86 defines an arc and in another portion thereof, is substantially straight. This arrangement is illustrated in FIG. 3 wherein the portion of the longitudinal axis 86 adjacent the second end 82 of the suspending pole 74 is substantially straight. In this application, a structure directly or indirectly coupled with the canopy fabric 26 tilts about the longitudinal axis 86 if the axis of rotation of the structure is co-linear with the axis 86 or at a tangent to the axis 86.

In some embodiments, the suspending pole 74 also can be extended and retracted relative to the supporting pole 54.

In one arrangement, a hub or head assembly 88 is positioned between the canopy assembly 18 and the suspending pole 74. The head assembly 88 preferably includes an upper portion 90 and a lower portion 92. The upper portion 90 is preferably located adjacent the second end 82 of the suspending pole 74. In one embodiment, the upper portion 90 of the head assembly 88 has an L-shape or elbow configuration, such that a portion thereof extends along the longitudinal axis 86 of the suspending pole 74 (or a tangent of the axis 86) and another portion extends substantially perpendicularly to the longitudinal axis 86 (or tangent). The portion of the upper portion 90 that extends along the longitudinal axis 86 preferably is rotatably coupled with the suspending pole 74, as discussed further below. The lower portion 92 of the head assembly 88 is coupled with the canopy assembly 18 in a suitable manner. In one arrangement, the upper and lower portions 90, 92 of the head assembly 88 are pivotably coupled. Pivotable coupling of the lower portion 92 to the upper portion 90 can be provided by a pin-type connection 94. The pin-type connection 94 can include a shaft that extends through a portion of the lower portion 92 and through a portion of the upper portion 90. The pin-type connection 94 can also include recesses formed in at least one of the upper and lower portions 90, 92 that enables the head assembly 88 to rotate to a compact storage configuration.

In one embodiment, the support pole assembly 14 also includes a strut 98. The strut 98 extends between a lower end 102 that is coupled with the support pole 54 and upper end 106 that is coupled with the suspending pole 74. Preferably, the lower end 102 of the strut 98 is pivotably coupled with the support pole 54 at a location between the upper end 62 and the lower end 58 thereof. The strut 98 preferably is pivotably coupled with the support pole 54 by a collar 114. In one arrangement, the collar 114 is mounted on the support pole 54 at a fixed elevation. In another embodiment, the collar 114 is configured to be clamped on to the support pole 54 or to be unclamped therefrom. When unclamped from the support pole 54, the collar 114 is enabled to move along the support pole 54 between a range of elevations. The ability of the collar 114 to move between different elevations is one way to enable the suspending pole 74 to be extended and retracted, as discussed further below. It should be appreciated that other means may be used to connect the strut 98 to the support pole 54 other than the collar 114, such as bolts and a flange or the like.

Figure 6:
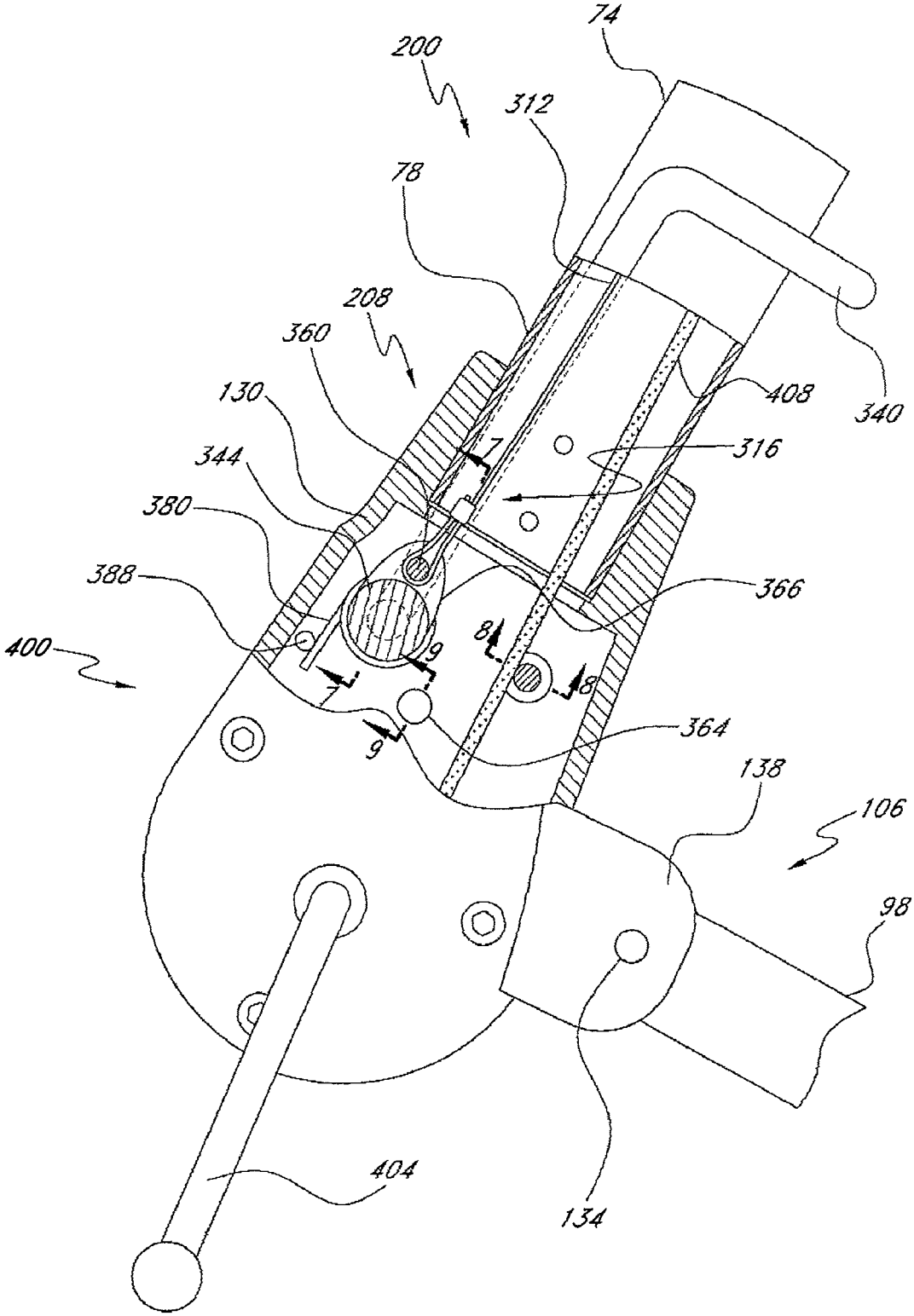
FIG. 6 is a partial cross-section view illustrating detail 3-3 of the umbrella of FIG. 1.
Figure 7:
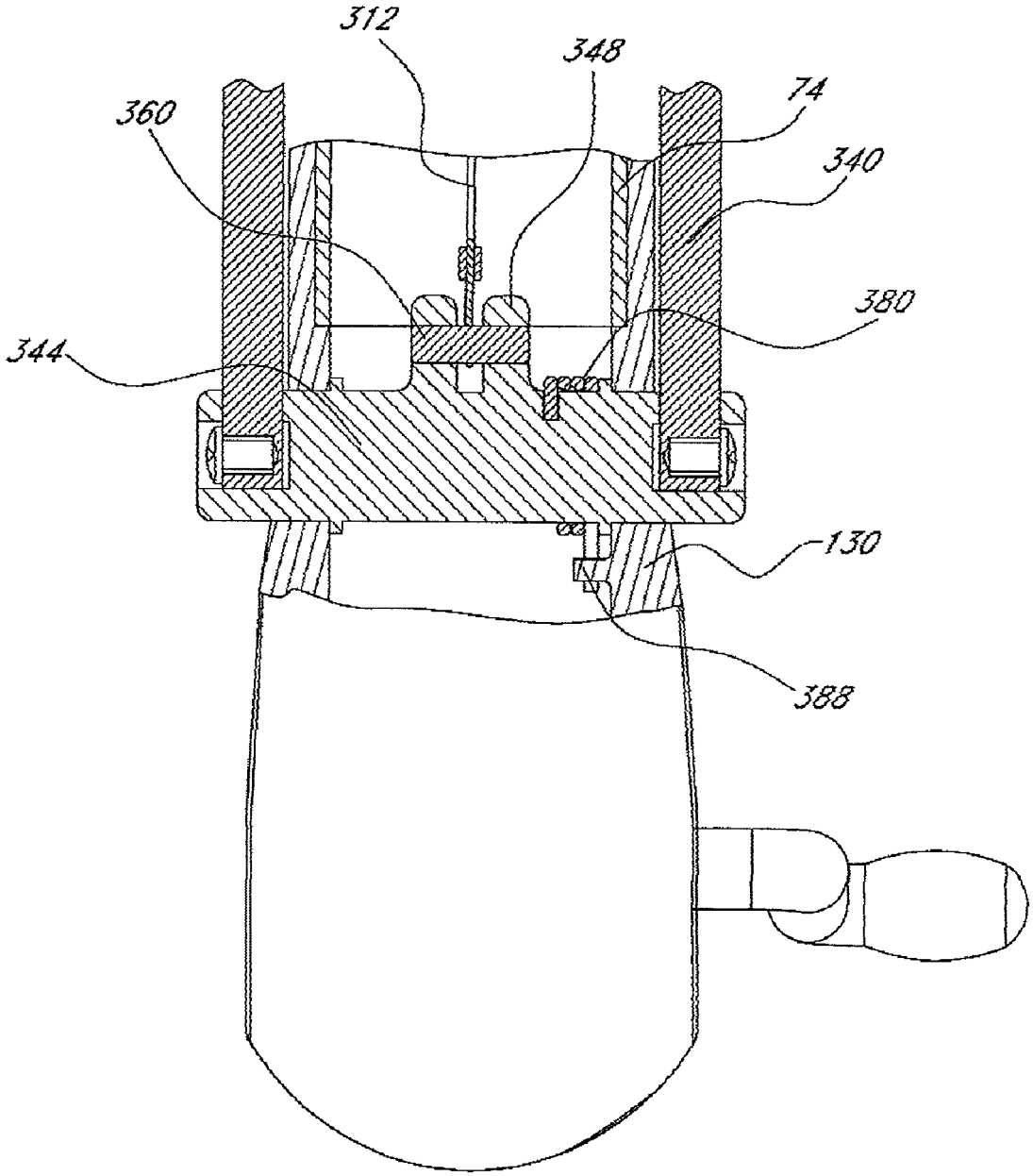
FIG. 7 is a cross section view of a lower portion of the umbrella of FIG. 1 taken along section plane 7-7.
Figure 9:
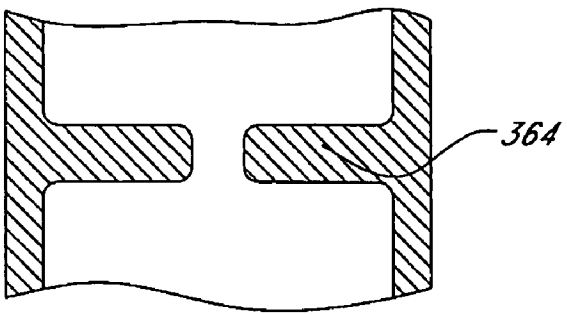
FIG. 9 is a cross-section view of a portion of a tilting mechanism, taken along section plane 9-9.
Figure 8:
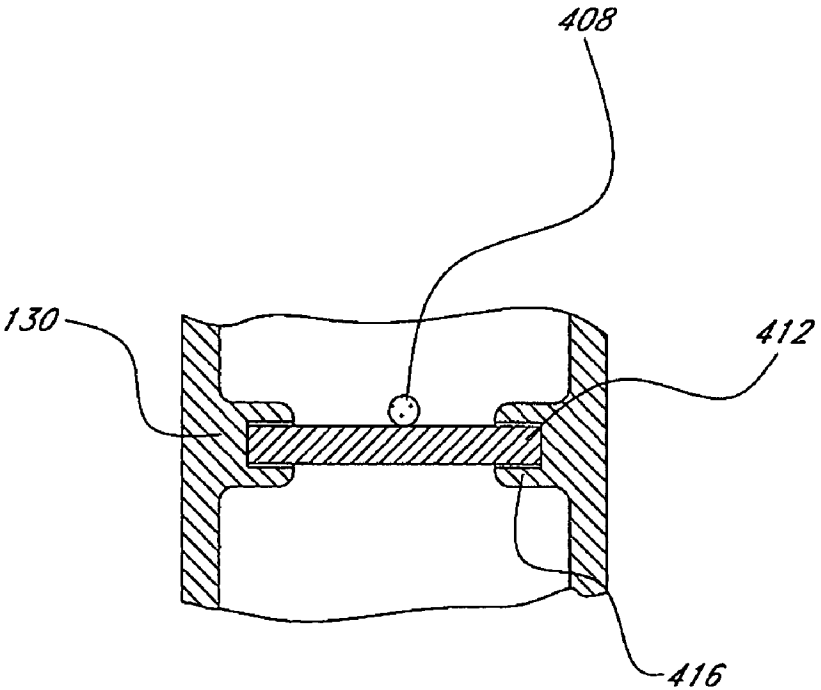
FIG. 8 is a cross-section view of a portion of a canopy deployment mechanism taken along section plane 8-8.
Figure 10:
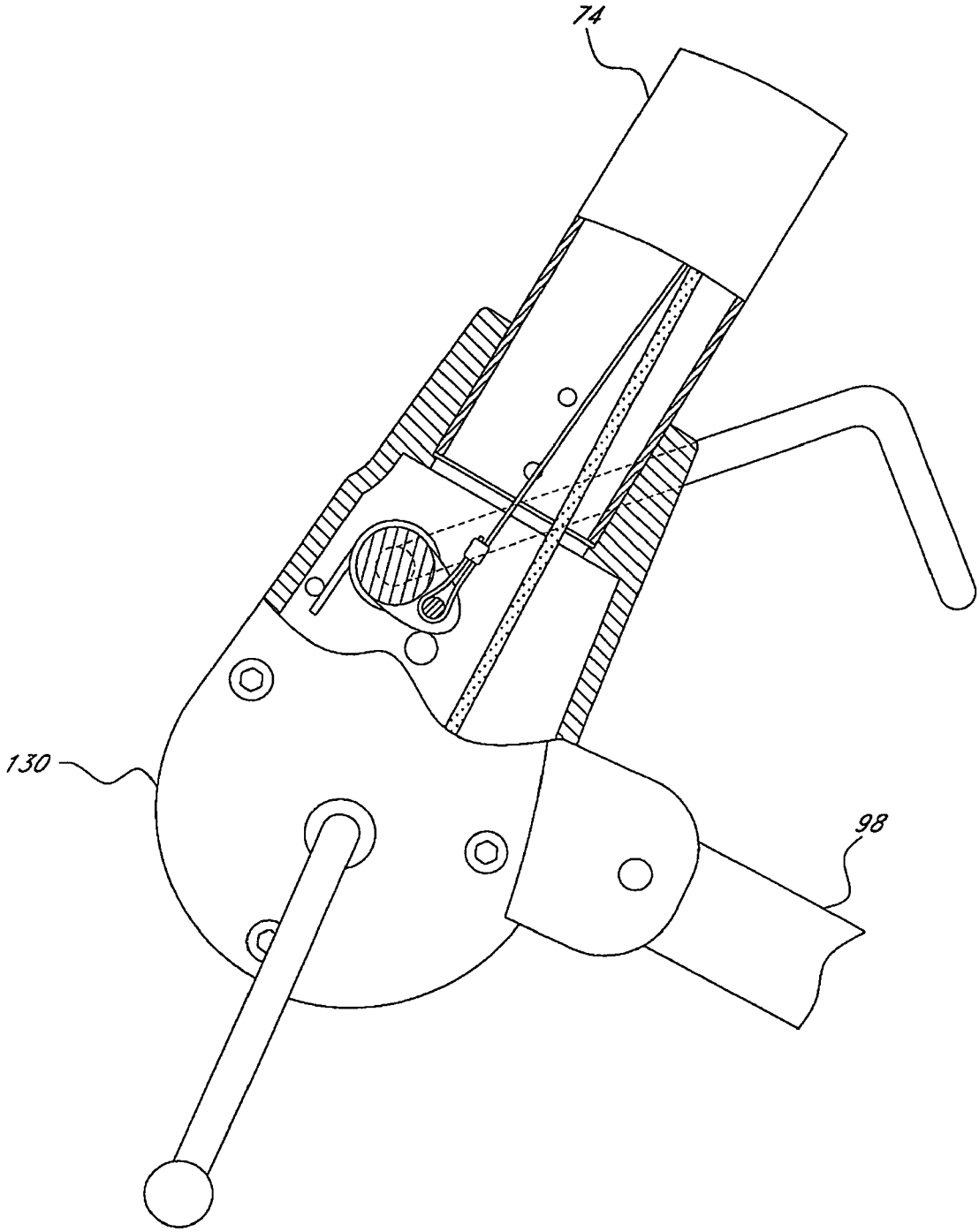
FIG. 10 is a partial cross-section view similar to FIG. 6 illustrating one technique for operation of an actuator operably coupled with the locking mechanism.

In one embodiment, the upper end 106 of the strut 98 is pivotably connected directly or indirectly to the suspending pole 74. Preferably, the upper end 106 of the strut is connected with a housing 130 located, as shown in FIG. 6, at or adjacent the first end 78 of the suspending pole 74. FIG. 6 shows that in one embodiment, a pivot shaft 134 is mounted in a fitting 138. The pivot shaft 134 is coupled with the upper end 106 of strut 98. The fitting 138 can be coupled with the housing 130 in any suitable manner, e.g., by welding. The pivotable coupling of the upper and lower ends 106, 102 of the strut 98 enables the strut to rotate out while the suspending pole 74 is being extended or retracted relative to the support pole 54, as discussed further below.

Figure 2:
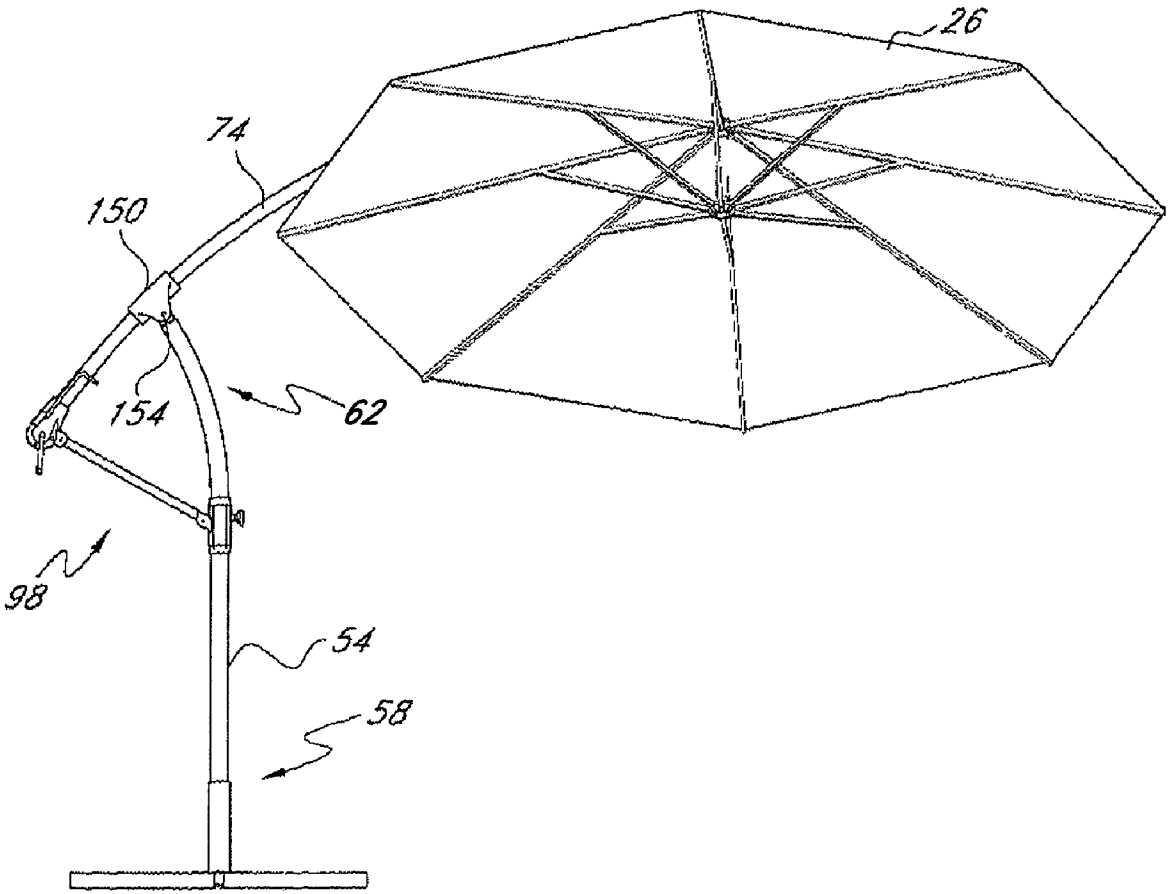
FIG. 2 is a plan view of the umbrella of FIG. 1 with the canopy thereof shown in an open configuration and in a second, tilted orientation.

FIGS. 1 and 2 show that in some embodiments a holding sleeve 150 is positioned between the support pole 54 and the suspending pole 74 so that the suspending pole 74 is mounted transversely to the support pole 54. The holding sleeve 150 preferably coupled with the suspending pole 74 and support pole 54 and is configured such that the suspending pole 74 can be extended and retracted relative to the support pole 54. By sliding the suspending pole 74 through the sleeve 150, the canopy assembly 18 can be moved away from or towards the support pole 54. In one embodiment, the sleeve 150 is pivotably mounted to the support pole 54, for example, using a pin connection 154. In one embodiment, an inner surface of the holding sleeve 150 that faces the suspending pole 74, comprises a low friction surface that facilitates the extension and retraction of the suspending pole 74. The low friction surface can take any suitable form, e.g., as a smooth surface, a low friction plastic surface, a bashing or a bearing if space permits.

The umbrella 10 can be coupled with a support structure in any suitable manner. In one embodiment, a base 162 is provided into which the lower end 58 of the support pole 54 can be inserted or otherwise mounted. The base 162 can take any suitable form, for example, being portable such that the umbrella 10 can be moved from one place to another. In some applications, the base 162 is a permanently fixed support portion, e.g., when coupled with a permanent structure, such as a concrete patio. A patio may include a recess sized to receiver or otherwise couple with the base 162 or with the lower end 58 of the support pole 54 so that the umbrella 10 can be supported.

As discussed above, various embodiments of the umbrella 10 preferably are configured such that at least a portion of the canopy assembly 18 can be moved to a selected position or configuration. In one embodiment, this capability is provided by mechanism that enables tilting of at least a portion of the canopy assembly 18 about the longitudinal axis 86 of the suspending pole 74. FIGS. 3 and 6 illustrate that the tilting mechanism is partly located adjacent the first end 78 of the suspending pole 74 and partly located adjacent the second end 82 of the suspending pole 74 in some embodiments. The titling mechanism 200 can take a variety of forms, but preferably is manually actuatable, as discussed below.

In one form, the tilting mechanism 200 includes a locking mechanism 204, one embodiment of which is shown in more detail in FIG. 3. In one arrangement, the locking mechanism 204 is located adjacent the second end 82 of the suspending pole 74. The tilting mechanism 200 preferably also includes an actuator 208, one embodiment of which is shown in more detail in FIG. 6. Preferably, the locking mechanism 204 is operably coupled with the actuator 208, for example, such that actuation of the actuator 208 releases, disengages, or unlocks the locking mechanism 204. As discussed further below, when the locking mechanism 204 is released, disengaged, or unlocked or at least a portion of the canopy assembly 18 is allowed or enabled to tilt about the longitudinal axis 86 of the suspending pole 74.

The tilting mechanism 200 can be used on any umbrella. The tilting mechanism 200 is useful for patio umbrellas, as discussed above, so as to permit the canopy assembly 18 to be moved as the sheltering needs change, e.g., as the sun moves across the sky. In one arrangement discussed further below, the canopy assembly 18 is repositioned manually, e.g., by hand, while the locking mechanism 204 is in a released, disengaged, or unlocked position or configuration. As discussed above, the actuator 208 is sometimes positioned at an opposite end of the suspending pole 74 from the locking mechanism 204. In this arrangement, it maybe advantageous to position the actuator such that the actuator is at least partially located between the first end 78 of the suspending pole and the canopy assembly 18 at least when the actuator 208 is in an unactuated position. This arrangement enables the largest distribution of users to comfortably actuate the actuator 208 with one hand and to grasp the canopy assembly 18 with the other hand to reposition canopy assembly 18 as discussed herein. However, in another embodiment, the actuator 208 can be configured such that it can be conveniently actuated with at least a portion thereof being located further from the second end 82 of the suspending pole 74 then is the first end 78 of the suspending pole.

As discussed above, the head assembly 88 is preferably rotatably mounted to the suspending pole 74. In one arrangement, shown in FIG. 3, an axle 212 is connected to the suspending pole 74. The axle 212 can be connected to the suspending pole 74 adjacent the second end 82. The axle 212 enables at least a portion of canopy assembly 18 to be tilted when the locking mechanism 204 is disengaged, as discussed further below. The axle 212 can take any suitable form. For example, in one arrangement, the axle 212 has a first portion 216 received within the suspending pole 74 and the second portion 220 that extends beyond the end of the suspending pole 74 when the umbrella 10 is assembled. The axle 212 preferably also includes a passageway 224 formed therein. Preferably, the passageway 224 is formed substantially in the center of the axle 212 ie. along a longitudinal axis. In one arrangement, the outer perimeter of the axle 212 has a different shape in the first portion 216 than in the second portion 220. For example, in the first portion 216, the outer shape of the axle 212 can have a polygonal outer perimeter, e.g., a hexagon or a septagon, and the second portion 220 can have a circular outer perimeter enabling rotation about the axle 212 of a structure thereon.

In one arrangement, the axle 212 is coupled with the suspending pole 74 by way of a collar 232 that can be positioned therebetween. The collar 232 can take any suitable form, but preferably includes an outer perimeter that substantially matches the inner perimeter of the suspending pole 74, and an inner perimeter that substantially matches the outer perimeter of the first portion 216 of the axle 212. For example, the collar 232 can have a circular outer perimeter and a hexagon or a septagonal inner perimeter or passageway. In one arrangement, the collar 232 is coupled with the axle 212 by one or a plurality of fastening members, such as screws 213. In one embodiment, the suspending pole 74 is coupled with the collar 232 by one or a plurality of fastening members, such as screws 233. Preferably, the collar member 232 includes a recess 234 into which at least a portion of the locking mechanism 204 can be received. The recess 234 is defined in one embodiment by a portion of the collar 232 that extends to the physical end of the suspending pole 74 and includes an outwardly extending flange portion 239. The flange portion 239 extends outwardly from the longitudinal axis 86 of the suspending pole 74 to provide a flush outer surface between the flange portion member 239 and the outer surface of the suspending pole 74. In one embodiment, a passage 238 is formed in the collar member 232. The passage 238 facilitates disengagement of the locking mechanism 204, as will be discussed below.

Preferably, the head assembly 88 is pivotably coupled to the axle 212, as discussed above. In one arrangement, a friction reducing member 270 is positioned between the axle 212 and the upper portion 90 of the head assembly 88. The friction reducing member 270 can take any suitable form, such as a bushing, a bearing (e.g., a roller or ball bearing), or any other suitable arrangement. In one configuration, a bearing mount collar 274 is positioned between the friction reducing member 270 in an inner surface of the portion of the upper portion 90 of the head assembly 88 that extends along the longitudinal axis 86 of the suspending pole 74. In one arrangement, a plurality of friction reducing members 270 are provided. In one embodiment, two bearings are provided between the axle 212 and the bearing mount collar 274. In one embodiment, the friction reducing member 270 is incorporated into the bearing mount collar 274, e.g., as a low friction surface thereof.

Figure 11:
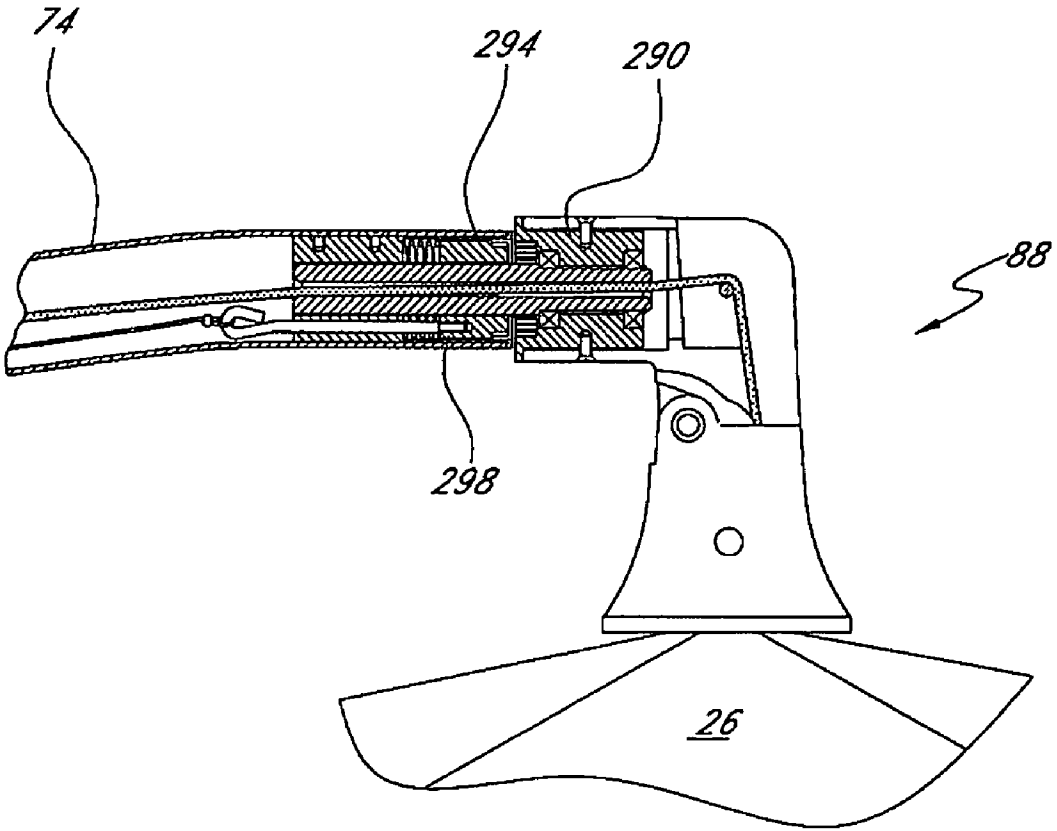
FIG. 11 is a partial cross-section view similar to FIG. 3 illustrating the locking mechanism in an unlocked, a decoupled, or released configuration.
Figure 5:
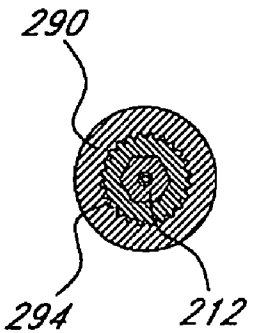
FIG. 5 is a cross-section view of an upper portion of the umbrella of FIG. 1 taken along section plane 5-5.

With reference to FIGS. 3, 5 and 11, additional features of the locking mechanism 204 will be discussed. The locking mechanism 204 preferably comprises a first locking member 290 coupled with the upper portion 90 of the head assembly 88 and a second locking member 294 at least partially positioned within the suspending pole 74. Preferably, the first and second locking members 290, 294 are configured such that relative movement therebetween causes the locking mechanism 204 to become engaged or disengaged. In one arrangement, the first and second locking members 290, 294 comprise first and second gears. In other arrangement, the first and second locking members 290, 294, comprise a plurality of gear teeth formed on separate structures. In one arrangement, the first locking member 290 comprises a plurality of gear teeth formed on a portion of the bearing mount collar 274. In another arrangement, the first locking member 290 comprises a plurality of gear teeth formed on an inner surface of an annular structure that is mounted within the head assembly 88, wherein the annular structure can be a separate, discrete piece from the bearing mount collar 274.

Preferably, the second locking member 294 is configured to be moved into and out of engagement with the first locking member 290. In one arrangement, the second locking member 294 is at least partially received within the recess 234 formed in the collar 232. In one arrangement, the second locking member 294 can be moved within the recess 234 such that the locking mechanism 204 can be engaged and disengaged. In one arrangement, a resilient member 298 is positioned between the second locking member 294 and a surface inside the recess 234. The resilient member 298 is a collar spring in one embodiment.

Movement of the second locking member 294 relative to the first locking member 290, can be provided by actuation of the actuator 208, as discussed further below. Where the first and second locking members 290, 294 are gears, the gears can be resiliently urged into engagement by the resilient or spring member 298 when the actuator 208 is in an unactuated position. As discussed further below, when the actuator 208 is in an unactuated position, in one arrangement, the second gear extends distal of the second end 82 of the suspending pole 74 and into engagement with the first gear.

In some arrangements, the tilting mechanism 200 includes a tension member 312 that extends between the actuator 208 and the locking mechanism 204. The tension member 312, alone or in combination with other components, operably couples the actuator 208 with the locking mechanism 204. In one arrangement, a first end 316 of the tension member is coupled with the actuator 208 adjacent the first end 78 of the suspending pole 74. In one embodiment, a second end 320 of the tension member 312 is coupled with an elongate member 324 that extends through the passage 238 and into engagement with the second locking member 294. The second end 320 of the tension member 312 can be coupled with the elongate member 324 in a suitable member, e.g., by a pair of interlocking hooks, or by providing a J hook on one end of the elongate member 324 and securely wrapping a portion of the tension member around the J hook.

FIG. 6 illustrates additional details of one embodiment of the actuator 208. In one embodiment, the actuator 208 includes an elongated member 340 that is configured to be grasped by user and to be actuated as discussed below. In one embodiment, the elongated member 340 is a lever or crank handle. In one arrangement, the elongated member 340 includes two L-shaped portions that extend along a portion of the first end 78 of the suspending pole 74 when the actuator 208 is not actuated and a connection portion that extends between the two L-shaped members at a location beneath the suspending pole 74. In one arrangement, the elongated member 340 is coupled with a shaft 344 having a mount post 348 to which the tension member 312 is coupled. In one embodiment, the shaft 344 includes a cam portion 366, adjacent to which the mount post 348 can be located. The shaft 344 is coupled with the elongated member 340 such that actuation of the elongated member 340 rotates the mount post 348. Rotation of the mount post 348 causes a force to be applied to the tension member 312 which is transmitted by the tension member to the second end 320 thereof. The force transmitted by the tension member 312 is applied to an elongate member 324, and thereby to the second locking member 294. Accordingly, operation of the actuator 208, e.g., by rotating the elongate member 340 to transmit a force through the tension member 312, causes the second locking member 294 to move out of engagement with the first locking member 290, releasing the locking mechanism 204. The locking mechanism is shown in a released or uncoupled configuration in FIG. 11. In this arrangement, the head assembly 88 and the canopy assembly 18 coupled thereto are free to rotate about the longitudinal axis 86 of the suspending pole 74.

In one embodiment, the tension member 312 can be coupled with the shaft 344 by a pin-type arrangement 360 as shown in FIG. 6. Movement of the first locking member 294 can be limited in some arrangements. For example, in one embodiment, the structure is located within the housing 130 that blocks the mounted post cam portion 366 or the mount post 348 at a selected angle of rotation. Accordingly, as the elongate member 340 is rotated, the cam portion 366 comes into contact with an abatement 364. When contact is made between these components, the rotation of the elongate member 340 is stopped and the movement of the second locking member 294 is stopped.

In one arrangement, a resilient member 380 is coupled with the shaft 344 and resiliently urges the shaft 344 and the elongated member 340 into an unactuated position, which is shown in FIG. 6. A resilient member 380 can be a coil spring in one embodiment. The resilient member 380 can couple with a shaft in a suitable manner. In one embodiment, a recess into which the main portion of the resilient member 380 can be inserted is formed in the shaft 344. The resilient member 380 can be coupled with a housing to enable a force to be applied to a shaft 344 in any suitable manner. In one arrangement, a resilient member engagement portion 388 extends outwardly from an inner surface of the housing 140 to engage another end portion of the resilient member 380.

In one arrangement, the umbrella 10 also includes a canopy deployment mechanism 400. The canopy deployment mechanism 400 is at least partially located within the suspending pole 74. In one arrangement, the canopy deployment mechanism 400 includes a crank member or a crank handle 404, that is rotatably coupled with the housing 130. The canopy deployment mechanism also may include a spool (not shown) about which a tension member 408 (e.g., a wire, cord or rope) can be wound.

The tension member 408 extends through the inner portion of the suspending pole 74 to the second end 82 thereof. In one arrangement, the tension member 408 extends through the axle 212 and into the upper portion 90 of the head assembly 88. In one arrangement, the tension number 408 also extends over a member which is configured to provide low friction contact with the tension member 408. The tension member 408 extends into a lower portion 92 of head assembly 88 and into engagement with a portion of the canopy assembly 18 such that when the tension member 408 is pulled or released by motion of the handle 404, the canopy assembly 18 is opened or closed. In one arrangement, the crank handle 404 and a spool form the portion of a crank mechanism.

In one arrangement, the canopy deployment mechanism also includes a member 412 mounted within the housing 130. In one arrangement, the member 412 is mounted between two recesses formed in the housing 130. The member 412 can be a roller that rolls when the tension member 408 moves along its outer surface. The member 412 can comprise a smooth, friction reducing surface. This arrangement reduces the force needed to be applied to the canopy deployment mechanism 400 to open and close the canopy assembly 18.

What is claimed is:

1. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis;

a tension member extending between the actuator and the locking device, the tension member applying a force to the locking device to release the locking device upon operation of the actuator; and a shaft having a mount post to which the tension member is coupled, the shaft being coupled with the actuator such that actuation thereof rotates the mount post, whereby a force is applied to the tension member.

2. The umbrella of claim 1, further comprising a head assembly between the second end of the suspending pole and the canopy and from which the canopy is suspended, in use, the head assembly being coupled to the second end of the suspending pole by means of the locking mechanism to normally prevent rotation of the head assembly with respect to the suspending pole, such rotation being permitted upon release of the locking device to decouple the head assembly from the second end of the suspending pole.

3. The umbrella of claim 1, wherein the actuator is located between the first end of the suspending pole and the canopy at least when the actuator is in an un-actuated position.

4. The umbrella of claim 1, wherein the longitudinal axis of the suspending pole defines an arc.

5. The umbrella of claim 1, further comprising a spring coupled with the shaft that resiliently urges the actuator to an un-actuated position.

6. The umbrella of claim 1, wherein the shaft includes a cam portion, the mount post being located on the cam portion offset from the axis of rotation of the shaft.

7. The umbrella of claim 6, further comprising a pin positioned adjacent the shaft so that a surface of the cam portion abuts the pin to limit the range of actuation of the actuator.

8. The umbrella of claim 1, wherein the locking device comprises a first gear coupled with the head assembly and a second gear coupled with the suspending pole adjacent the second end thereof, wherein actuation of the actuator permits relative movement between the first and second gears such that the locking device is disengaged.

9. The umbrella of claim 8, wherein actuation of the actuator moves the second gear away from the first gear such to disengaged the locking device.

10. The umbrella of claim 1, further comprising an axle connected to the suspending pole adjacent the second end thereof about which the canopy can be tilted when the locking device is disengaged.

11. The umbrella of claim 1, further comprising a clamp and a holding sleeve coupled with the upper end of the support pole, the holding sleeve permitting extension and retraction of the suspending pole and canopy relative to the support pole.

12. The umbrella of claim 11, wherein the clamp comprises a sleeve coupled with the support pole, the sleeve being actuatable to increase or reduce friction between the sleeve and the support pole, and further comprising a strut extending between the clamp and the first end of the suspending tube, wherein the clamp and strut are configured to fix the suspending pole in a selected position relative to the support pole.

13. The umbrella of claim 1, wherein the actuator tensions the locking device to release the locking device.

14. The umbrella of claim 1, wherein the actuator applies tension to a tension member that releases the locking device.

15. The umbrella of claim 1, wherein relaxation of the actuator locks the locking device.

16. The umbrella of claim 1, wherein the locking device is biased into a locked position.

17. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis, a head assembly between the second end of the suspending pole and the canopy and from which the canopy is suspended, in use, the head assembly being coupled to the second end of the suspending pole by means of the locking mechanism to normally prevent rotation of the head assembly with respect to the suspending pole, such rotation being permitted upon release of the locking device to decouple the head assembly from the second end of the suspending pole;

wherein the locking mechanism further comprises a first gear coupled with the head assembly and a second gear coupled with the suspending pole adjacent the second end thereof, wherein actuation of the actuator permits relative movement between the first and second gears such that the locking device is disengaged, and wherein the first and second gears are resiliently urged into engagement by a spring member when the actuator is in an un-actuated position.

18. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis, a head assembly between the second end of the suspending pole and the canopy and from which the canopy is suspended, in use, the head assembly being coupled to the second end of the suspending pole by means of the locking mechanism to normally prevent rotation of the head assembly with respect to the suspending pole, such rotation being permitted upon release of the locking device to decouple the head assembly from the second end of the suspending pole;

wherein the locking mechanism further comprises a first gear coupled with the head assembly and a second gear coupled with the suspending pole adjacent the second end thereof, wherein actuation of the actuator permits relative movement between the first and second gears such that the locking device is disengaged, and wherein the second gear extends distal of the second end of the suspending pole to engage the first gear when the actuator is in an un-actuated position.

19. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis, and a head assembly between the second end of the suspending pole and the canopy and from which the canopy is suspended, in use, the head assembly being coupled to the second end of the suspending pole by means of the locking mechanism to normally prevent rotation of the head assembly with respect to the suspending pole, such rotation being permitted upon release of the locking device to decouple the head assembly from the second end of the suspending pole;

wherein the locking mechanism further comprises a first gear coupled with the head assembly and a second gear coupled with the suspending pole adjacent the second end thereof, wherein actuation of the actuator permits relative movement between the first and second gears such that the locking device is disengaged, and wherein actuation of the actuator moves the second gear along the longitudinal axis of the suspending pole.

20. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis;

an axle connected to the suspending pole adjacent the second end thereof about which the canopy can be tilted when the locking device is disengaged; and a canopy deployment mechanism at least partially located within the suspending pole.

21. The umbrella of claim 20, wherein the canopy deployment mechanism at least partially extends through the axle.

22. The umbrella of claim 21, wherein the canopy deployment mechanism comprises a rope coupled at one end with the canopy and at an opposite end with a crank mechanism, the rope configured to extend through a bore formed in the axle.

23. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis; and an axle connected to the suspending pole adjacent the second end thereof about which the canopy can be tilted when the locking device is disengaged, wherein a friction reducing device is positioned between a head assembly coupled with the canopy and the axle to reduce the force needed to rotate the canopy about the longitudinal axis of the suspending pole.

24. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for enabling tilting of the canopy about the longitudinal axis of the support pole, comprising an actuator adjacent the first end of the suspending pole and a locking mechanism comprising a locking device operably coupled with the actuator and located adjacent the second end of the suspending pole, wherein operation of the actuator releases the locking device permitting the canopy to tilt about an axis of rotation that extends along the longitudinal axis; and an actuation limiter configured to at least partially define a range of actuation of the actuator.

25. An umbrella comprising:

a support pole, at least a portion of which extends upwardly in use;

a suspending pole, mounted transversely to the support pole and having first and second ends and a longitudinal axis that defines an arc;

a hub attached to second end of suspending pole;

a canopy suspended in use from the hub;

means for coupling and decoupling the hub from the suspending pole to permit rotating the canopy about an axis of rotation that extends along the longitudinal axis of the supporting pole; and wherein said coupling and decoupling means comprises a first connector in the suspending pole and having a first mating surface and a second connector in the hub and having a second mating surface, the first connector having a portion being movable with respect to the second connector so that the first mating surface can be engaged with or disengaged from the second mating surface to lock or release, respectively, the hub with respect to the suspending pole, so that the hub can be rotated with respect to the suspending pole; and a pin extending from the first connector into an internal passageway in the second connector and about which the second connector and the hub can rotate.

26. The umbrella of claim 25, further comprising a pair of gears located adjacent the second end of the suspending pole, one of said gears being coupled with the suspending pole and the other of said gears being coupled with the hub, said gears being actuatable by a lever located adjacent the first end of the suspending pole.

27. The umbrella of claim 25, further comprising a first connector in the suspending pole having a first mating surface and a second connector in the hub having a second mating surface, the first connector having a portion being movable with respect to the second connector so that the first mating surface can be engaged with or disengaged from the second mating surface to lock or release, respectively, the hub with respect to the suspending pole, so that the hub can be rotated with respect to the suspending pole.

28. The umbrella of claim 27, comprising means for biasing the first connector into locking engagement with the second connector.

29. The umbrella of claim 25, further comprising means adjacent the first end of the suspending pole for operating the means for coupling and decoupling the hub from the suspending pole.

30. The umbrella of claim 29, wherein the operating means comprises, a crank shaft;

an elongate member connected to the crank shaft and the first connector; and a crank handle for applying tension to the elongate member to decouple the hub from the suspending pole.

31. The umbrella of claim 25, wherein the hub and suspending pole are biased into a coupled state.

* * * * *